US007052249B2

(12) United States Patent
Virgilio

(10) Patent No.: US 7,052,249 B2
(45) Date of Patent: May 30, 2006

(54) AIR/OIL SEPARATING TANK—THERMOSTATIC VALVE—MINIMUM PRESSURE VALVE—OIL COOLING RADIATOR—COMPRESSED AIR COOLING RADIATOR GROUP

(76) Inventor: Mietto Virgilio, Via Como, 17, 36051 Olmo di Creazzo (IT)

( * ) Notice: Subject to any disclaimer, the term of this patent is extended or adjusted under 35 U.S.C. 154(b) by 405 days.

(21) Appl. No.: 10/418,521

(22) Filed: Apr. 18, 2003

(65) Prior Publication Data

US 2004/0011517 A1 Jan. 22, 2004

(30) Foreign Application Priority Data

May 3, 2002 (IT) ..... VI2002A0083

(51) Int. Cl.
*F04B 23/00* (2006.01)

(52) U.S. Cl. ..... 417/313; 417/228; 418/85; 418/87; 418/DIG. 1; 184/6.16

(58) Field of Classification Search ..... 417/313, 417/228, DIG. 1; 418/85, 87; 184/6.16
See application file for complete search history.

(56) References Cited

U.S. PATENT DOCUMENTS

| | | | | | |
|---|---|---|---|---|---|
| 4,394,113 | A | * | 7/1983 | Bammert | 418/98 |
| 4,475,876 | A | * | 10/1984 | Olen | 418/84 |
| 4,651,816 | A | | 3/1987 | Struss | |
| 4,671,748 | A | * | 6/1987 | Cirelli | 418/83 |
| 5,056,601 | A | * | 10/1991 | Grimmer | 165/47 |
| 5,363,651 | A | * | 11/1994 | Knight | 60/595 |
| 5,447,422 | A | | 9/1995 | Hoki | |
| 6,164,071 | A | * | 12/2000 | Shao et al. | 60/605.2 |

* cited by examiner

*Primary Examiner*—Charles G. Freay
*Assistant Examiner*—Ryan P. Gillan
(74) *Attorney, Agent, or Firm*—Bucknam and Archer; Joseph J. Orlando

(57) ABSTRACT

A group is provided for a compressed air distribution unit of the type including an intake regulator, an oil bath-screw type compressor, an air/oil separating tank, a minimum pressure valve, an air cooling radiator, a pressurized air collection tank, a thermostatic valve, and an oil cooling radiator, wherein the group includes the air/oil separating tank, the thermostatic valve, the minimum pressure valve, the oil cooling radiator, the air cooling radiator all connected to a cover for the air/oil separating tank resulting in a single-block group.

7 Claims, 2 Drawing Sheets

AIR/OIL SEPARATING TANK—THERMOSTATIC VALVE—MINIMUM PRESSURE VALVE—OIL COOLING RADIATOR—COMPRESSED AIR COOLING RADIATOR GROUP

FIELD OF THE INVENTION

The present invention relates generally to a compressed air production unit or system and, more particularly, it relates to such a system in which several separate elements of the system are connected in the form of a group.

BACKGROUND OF THE INVENTION

In industrial applications it is well known to have a unit or system for producing compressed air essentially consisting of an oil bath-screw type compressor, an air/oil separating tank, a tank for collecting the pressurized air and two radiators arranged downstream of the air/oil separating tank, respectively intended for cooling the purified oil which is returned to the compressor, and the pressurized air which is collected in the collection tank.

At the present state of the art, the oil cooling radiator and the compressed air cooling radiator are always substantially bulky, since, even in systems with an average air flow rate, the radiators must dispose of a large amount of heat. This means that in units for compressed air which are normally produced, the radiators constitute groups which are autonomous as well as separate from the other apparatuses to which they are connected through rigid and/or flexible piping. The consequent disadvantages of this system relates to the construction, assembly and maintenance of the unit itself, as well as its operation, due to the substantial pressure drops in the piping of the circuit.

SUMMARY OF THE INVENTION

The object of the present invention is to provide a constructive solution which simplifies a compressed air production unit or system of the type described above and, specifically, which eliminates the connection piping between the air/oil separating tank with the oil and air cooling radiators.

The above object is accomplished by providing that the air/oil separating tank be equipped with a cover which consists of a worked metal block which, besides acting as an upper closing flange for the tank itself, comprises the inlet connection for the air/oil mixture, the thermostatic valve, the minimum pressure valve, the oil filter and the air filter and is, in particular, also equipped with a connection which allows direct coupling with the two cooling radiators.

In a preferred embodiment, this connection consists of a flange in which the discharge and return ducts for the oil and air outlet duct are formed and which also acts as a support for the two radiators which, advantageously, can constitute a single body.

With such a constructive solution a single-block group results, comprising the air/oil separating tank, the thermostatic valve, the minimum pressure valve and the cooling radiators, which is compact, small in size and easy to assemble and which also advantageously results in a substantial reduction in pressure drop.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE INVENTION

Figure 1:
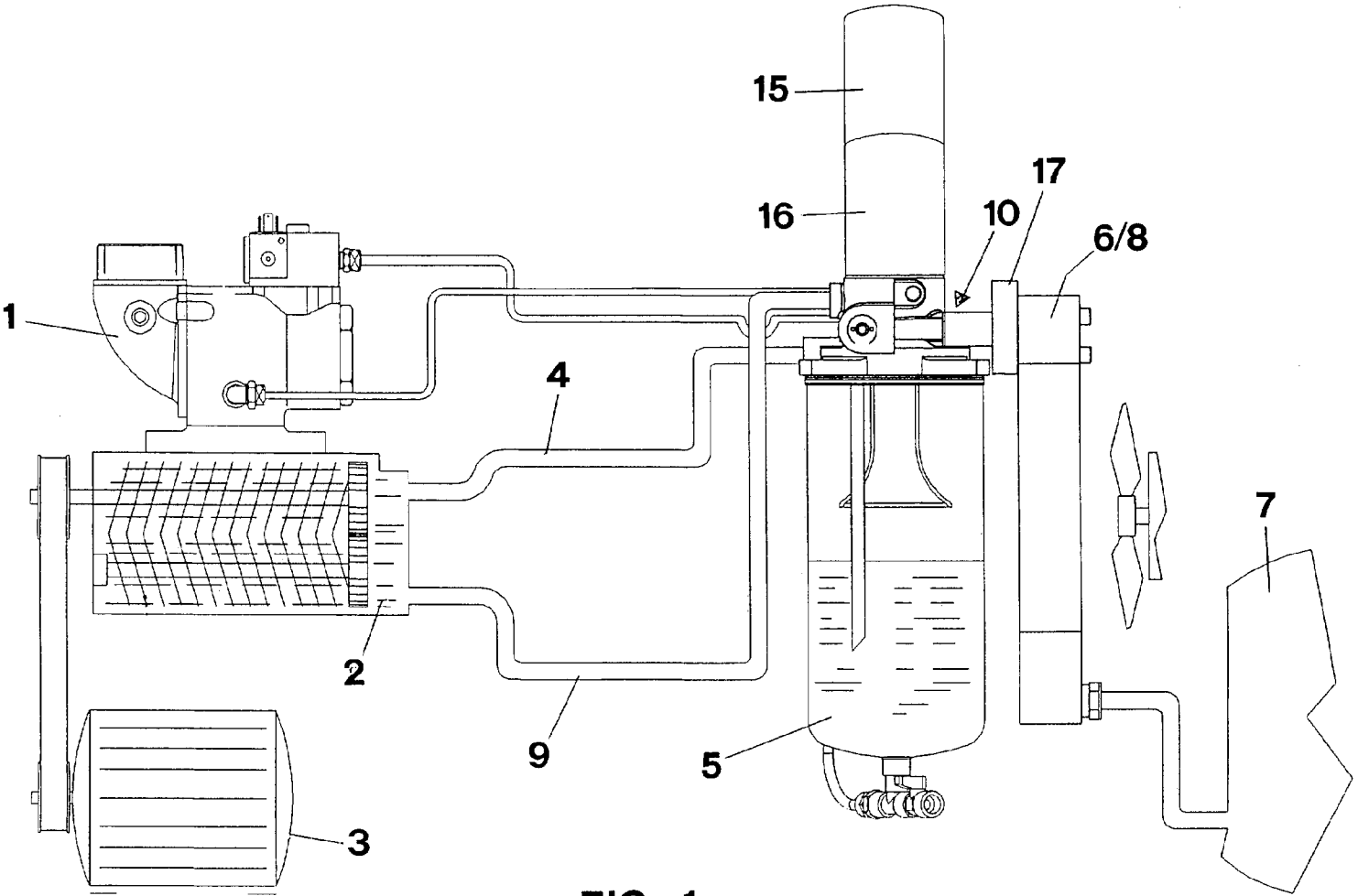
FIG. 1 is a side elevational view of a unit for producing compressed air through an oil bath-screw type compressor equipped with the group according to the present invention.

As seen in FIG. 1, the unit for producing compressed air is made up of an intake regulator 1, which intercepts the outside air and conveys it to the oil bath-screw type compressor 2 which is actuated by the motor 3.

The pressurized air/oil mixture leaves compressor 2 and is passed to inlet connection 11 via duct 4 and enters into the air/oil separating tank 5, where the separation of the oil from the air takes place. The pressurized air removed from separating tank 5 is filtered in air filter 15 while the oil removed from separating tank 5 is filtered in oil filter 16. The pressurized air then passes through the cooling radiator 6 and is collected in collection tank 7, whereas the purified oil passes through the cooling radiator 8 and, through outlet connections 12 and duct 9, is caused to flow back to the compressor 2.

Figure 4:
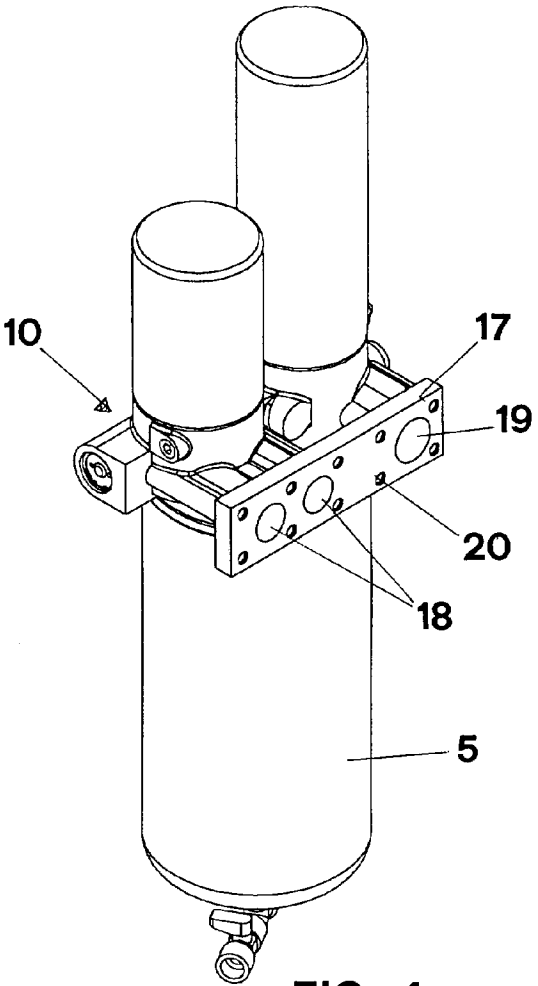
FIG. 4 is a perspective view of the group according to the present invention without the cooling radiators.
Figure 3:
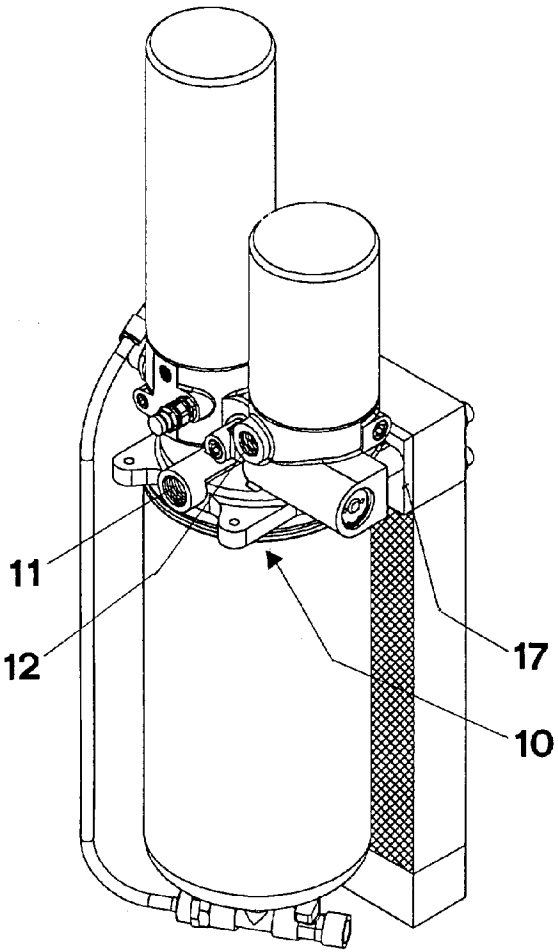
FIGS. 2 and 3 are two perspective views of the group according to the present invention.
Figure 2:
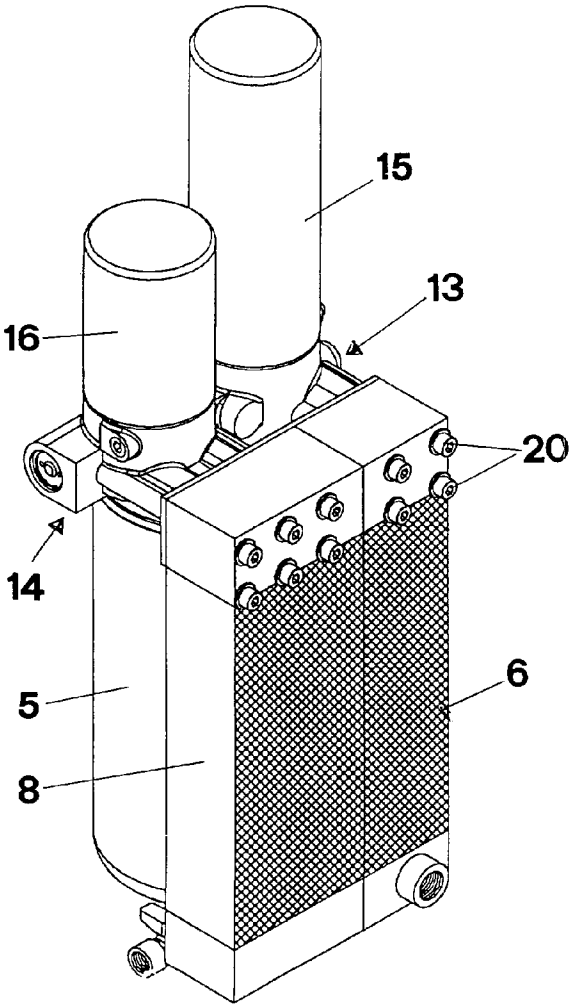

As can be seen in FIGS. 2 to 4, the cover 10 of the air/oil separating tank 5 consists of a worked metal block in which are formed the inlet connection 11 for the air/oil mixture, the outlet connection 12 for the purified oil, the minimum pressure valve 13, the thermostatic valve 14, the connections for the air filter 15 and for the oil filter 16, as well as a flange 17, equipped with the ducts 18 and 19, respectively for the discharge and return of the oil and for discharging the air, on which the air radiator 6 and the oil radiator 8 are applied, held locked thereto by the screws 20.

A possible variant of the invention foresees that on the flange 17 just one of the two types of radiator is applied, as in the case of use of the air/oil separating tank, described in U.S. application Ser. No. 10/237,762 filed Sep. 9, 2002, the disclosure of which is incorporated herein by reference, which, due to its constructive details, may not require the use of the oil cooling radiator.

Accordingly, while at least one embodiment of the present invention has been shown and described, it is to be understood that many changes and modifications may be made thereunto without departing from the spirit and scope of the invention as defined in the appended claims.

What is claimed is:

1. A group including an air/oil separating tank, a thermostatic valve, a minimum pressure valve, an oil cooling radiator, a compressed air cooling radiator, said group adapted to be installed in a compressed air distribution unit of the type which includes an intake regulator (1) which intercepts the outside air and conveys it to an oil bathscrew type compressor (2) actuated by a motor (3), the air/oil mixture enters into said air/oil separating tank (5) via a duct (4), where the oil and air are separated, the pressurized air passes through said minimum pressure valve (13) and cooling radiator (6) and is collected in a collection tank (7) whereas the purified oil passes through said thermostatic valve (14) and cooling radiator (8) and is caused to return to said compressor(2) via a duct (9), said group further including a cover for the air/oil separating tank having means for the direct connection thereto of said air cooling radiator and said oil cooling radiator.

2. The group according to claim 1, wherein said cover for the air/oil separating tank is equipped with a flange for the direct connection of the air cooling radiator and the oil cooling radiator.

3. The group according to claim 1, wherein said cover for the air/oil separating tank consists of a worked metal block (10) which, besides acting as an upper closing flange for the tank itself, includes an inlet connection (11) for the air/oil mixture, an outlet connection (12) for the purified oil, said minimum pressure valve (13), said thermostatic valve (14), an air filter (15) and an oil filter (16) and a flange (17) which permits direct coupling with the bodies of the two oil and air cooling radiators (6, 8).

4. The group according to claim 3, wherein said flange (17), which permits direct coupling with the bodies of the two oil and air cooling radiators (6, 8), includes a discharge duct (18) and a return duct (18) for the oil and a discharge duct (19) for the air.

5. The group according to claim 4, wherein the oil and air cooling radiators (6, 8) are connected to the flange (17) by means of screws (20).

6. The group according to claim 1, wherein said two oil and air cooling radiators (6, 8) constitute a single body.

7. The group according to claim 1, wherein said group constitutes a single-block group.

* * * * *